United States Patent [19]

Itoh

[11] Patent Number: 4,595,806

[45] Date of Patent: Jun. 17, 1986

[54] ON-LOAD TAP CHANGER

[75] Inventor: Katsuaki Itoh, Kobe, Japan

[73] Assignee: Mitsubishi Denki Kabushiki Kaisha, Tokyo, Japan

[21] Appl. No.: 679,294

[22] Filed: Dec. 7, 1984

[30] Foreign Application Priority Data

Dec. 8, 1983 [JP] Japan ..... 58-232979

[51] Int. Cl.[4] ..... H01H 3/44; H01H 19/54

[52] U.S. Cl. ..... 200/11 TC; 200/153 PA

[58] Field of Search ..... 200/8 R, 8 A, 11 TC, 200/17 R, 18, 153 PA

[56] References Cited

U.S. PATENT DOCUMENTS

| | | | |
|---|---|---|---|
| 3,246,088 | 4/1966 | Maunder | 200/11 TC |
| 3,250,864 | 5/1966 | Bleibtreu et al. | 200/153 PA X |
| 3,396,254 | 8/1968 | Bleibtreu | 200/11 TC X |
| 3,485,965 | 12/1969 | Bleibtreu et al. | 200/11 TC |
| 3,798,395 | 3/1974 | Norman et al. | 200/11 TC X |

*Primary Examiner*—J. R. Scott

*Attorney, Agent, or Firm*—Wenderoth, Lind & Ponack

[57] ABSTRACT

An on-load tap changer which comprises a rotary selector switch including a plurality of contacts which are divided according to phases into groups which are arranged in the axial direction of the tap changer, a rotary change-over switch including a plurality of contacts, and an intermittent drive mechanism connected between the selector switch and the change-over switch for intermittently transmitting the rotary motion of the selector switch to the change-over switch, the intermittent drive mechanism having an asymmetrical shape which provides a closest portion that is closest to the contacts of the change-over switch. The arrangement is such that the contacts of the change-over switch are divided into groups according to phases which are arranged in the circumferential direction of the change-over switch, the intermittent drive mechanism is at an electrical potential equal to that of the contacts of the selector switch closest to the intermittent drive mechanism, and the closest portion of the intermittent drive mechanism is positioned within a phase region within which the closest portion is positioned.

4 Claims, 10 Drawing Figures

ON-LOAD TAP CHANGER

BACKGROUND OF THE INVENTION

This invention relates to an on-load tap changer for use with an electric apparatus such as a transformer, and more particularly, to a compact on-load tap changer of a selector switch type, comprising a selector switch and a change-over switch enclosed within an insulating housing.

A conventional on-load tap changer of a selector switch type is schematically shown in FIGS. 1, 5, 6, 7 and 8. In FIG. 1, an on-load tap changer 10 is shown consisting of an electrically insulating housing 12, a selector switch 24 and a change-over switch 44. The electrically insulating housing 12 comprises a first insulating housing 14, a second insulating housing 16 and partition wall 18 between the two housings 14 and 16. The interior of the housing 12 is divided by the partition wall 18 into a first compartment 20 and a second compartment 22.

The selector switch 24 is installed in the first compartment 20 isolated from the transformer insulating oil by the first insulating housing 14 and the partition wall 18, and consists of an output shaft 31 operated by a quick motion mechanism 28 with a worm wheel 26, movable contacts 32 with a rotary contact system and fixed contacts 34. The movable contacts 32 of the selector switch 24 are mounted on the output shaft 31, and the fixed contacts 34 of the selector switch 24 on the inner surface of the first insulating housing 14. The contacts 32 and 34 of the selector switch 24 are divided into three groups each for the respective phases and the contact groups are axially stacked in the direction of the axis of the tap changer 10. When the worm wheel 26 is rotated, a rotating shaft 30 connected at one end (the upper end in FIG. 1) to the worm wheel 26 is rotated and a desired energy is accumulated in the tension spring within the quick motion mechanism 28. After this, the energy accumulated in the tension spring is released accordingly to rotate the output shaft 31 and select a desired tap position.

The other end (the lower end in FIG. 1) of the rotating shaft 30 is connected to one end of an input shaft 36 through a coupling 38. The input shaft 36 is rotatably supported by a bearing 40 carried by the partition wall 18 and extends at the other end through the partition wall 18 into the second compartment 22 within the second insulating housing 16. The other or lower end of the input shaft 36 is connected to an intermittent drive mechanism 42 disposed within the second compartment 22 immersed in the transformer oil. A change-over switch 44 is also disposed within the second compartment 22 and is connected to the intermittent drive mechanism 42 through an output shaft 46. The change-over switch 44 comprises a plurality of movable roller contacts 48 secured to the output shaft 46 through a contact holder and a plurality of fixed contacts 50 mounted on the inner surface of the second insulating housing 16. When the output shaft 46 rotates, the movable contacts 48 rotate relative to the fixed contacts 50 to effect switching according to the rotational position of the movable contacts 48.

In the conventional on-load tap changer described above, the number of the fixed contacts 32 of the selector switch 24 is very large. Therefore, when this large number of contacts 32 are to be disposed circumferentially within the first insulating housing 14, they must be phase-divided in the direction of the axis of the first insulating housing 14 into first, second and third phases, for example Phase I, Phase II and Phase III in FIG. 1). The fixed contacts in each phase include respective collector contacts 39 at the bottom ends thereof as shown in FIG. 1. Thus, the axial length of the entire on-load tap changer 10 is inevitably increased and the tap changer 10 becomes large-sized. Therefore, the only way of reducing the entire length of the on-load tap changer 10 and making the device small-sized is to reduce the axial length of the change-over switch 44 in the second insulating housing 16.

This problem of increased length of the tap changer is particularly serious with an on-load tap changer for use with an electrical transformer using a delta connection as shown in FIG. 2.

That is, in FIG. 2 in which three transformer windings are connected in the delta connection, each of the transformer windings comprises a first and a second transformer main winding 52 and 54, and a tap winding 56 between the transformer main windings 52 and 54. The first main winding 52 and the tap winding 56 are connected by the change-over switch 44, and the tap winding 56 and the second main winding 54 are connected by the selector switch 24. The first transformer main winding 52 has taps on the fixed contacts 50 that can be selectively connected by the movable contacts 48 (FIG. 1) of the change-over switch 44. The taps with which the change-over switch 44 can be connected provide a change-over switch winding 58 which is a section of the transformer main winding 52. The tap winding 56 has a plurality of tappings which are connected to the fixed contacts 34 (FIG. 1) of the selector switch 24 and which can be selectively connected by the movable contacts 32 (FIG. 1) of the tap changer 24.

Although not illustrated, three change-over switches 44 and three selector switches 24 of three phases are mechanically linked so that they are actuated in unison. The voltage at the tap winding 56 is generally 10% of the phase voltage, and the change-over switch winding 58 of the transformer main winding 52 has a voltage substantially identical to that of the tap winding 56. As apparent from FIG. 2, about one half of the interline voltage of the transformer main windings 52 and 54 appears between the phases between the selector switch 24 and the change-over switch 44, and as described above, the inter-phase distance of the selector switch 24 which is phase-divided in the axial direction is inevitably axially elongated as compared with the case where the connection used is a star connection.

SUMMARY OF THE INVENTION

Accordingly, an object of the present invention is to provide an on-load tap changer that is compact in size.

Another object of the present invention is to provide an on-load tap changer that is simple and reliable.

With the above objects in view, the present invention contemplates to provide an on-load tap changer which comprises a rotary selector switch including a plurality of contacts which are divided according to phases into groups which are arranged in the axial direction of the tap changer, a rotary change-over swtich including a plurality of contacts, and an intermittent drive mechanism connected between the selector switch and the change-over switch for intermittently transmitting the rotary motion of the selector switch to the change-over switch, the intermittent drive mechanism having an asymmetrical shape such that it has a portion that is closer to the contacts of the change-over switch than its other portions. The arrangement is such that the contacts of the change-over switch are divided into groups according to phases which are arranged in the circumferential direction of the change-over switch, the intermittent drive mechanism is at an electrical potential equal to that of the contacts of the selector switch closest to the intermittent drive mechanism, and the closest portion of the intermittent drive mechanism is positioned within the phase region corresponding to the phase of the selector switch contacts which are closest to the intermittent drive mechanism.

BRIEF DESCRIPTION OF THE DRAWINGS

The invention will become more readily apparent from the following description of the preferred embodiment of the present invention taken in conjunction with the accompanying drawings, in which.

DESCRIPTION OF THE PREFERRED EMBODIMENT

Figure 1:
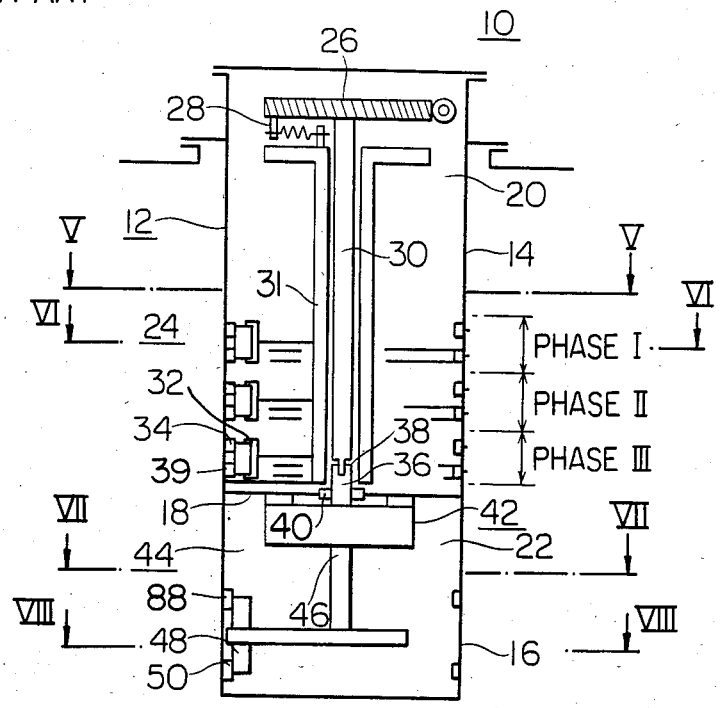
FIG. 1 PRIOR ART
FIG. 1 is a vertical schematic sectional view showing a conventional on-load tap changer.
Figure 2:
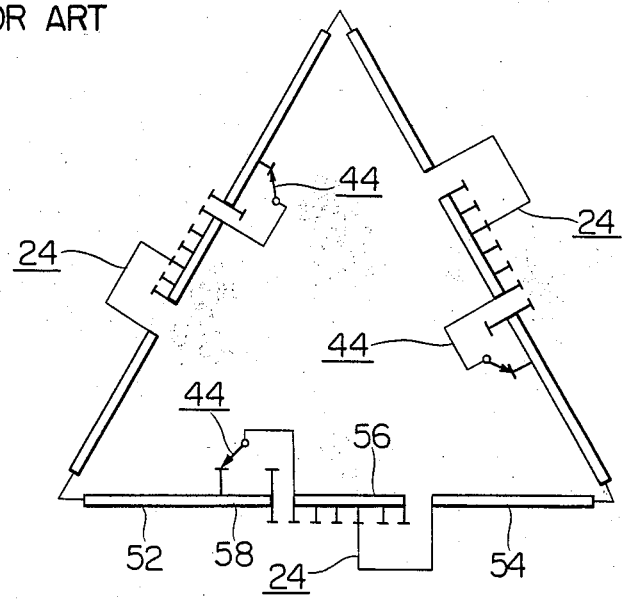
FIG. 2 PRIOR ART
FIG. 2 is a schematic drawing for explaining the triangular connection.
Figure 3:
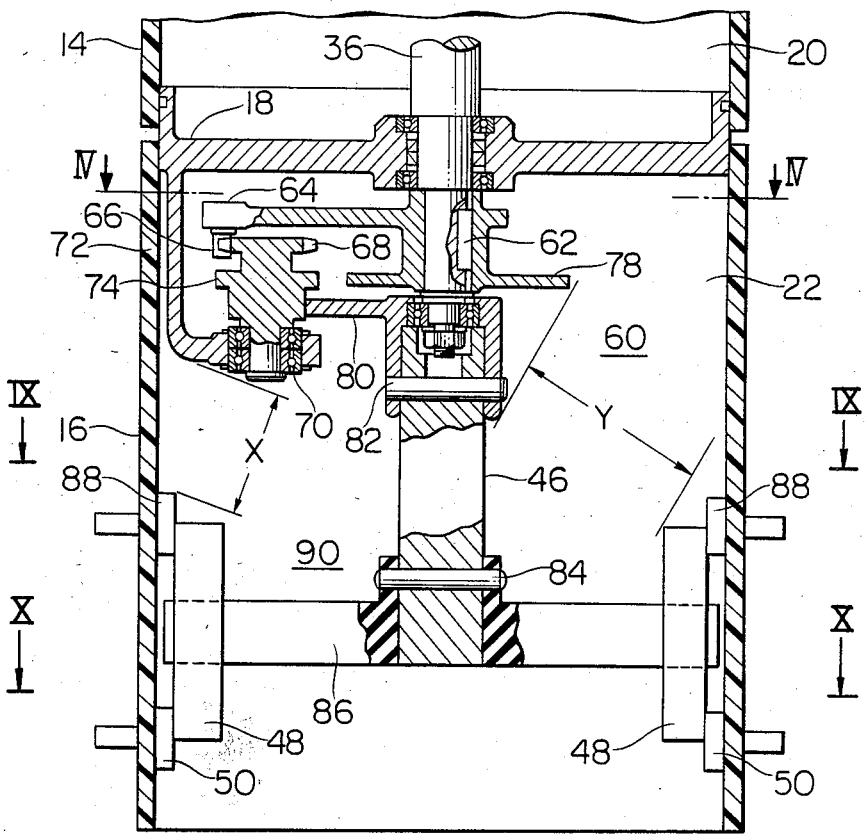
FIG. 3 is a vertical sectional view of the on-load tap changer of the present invention.
Figure 4:
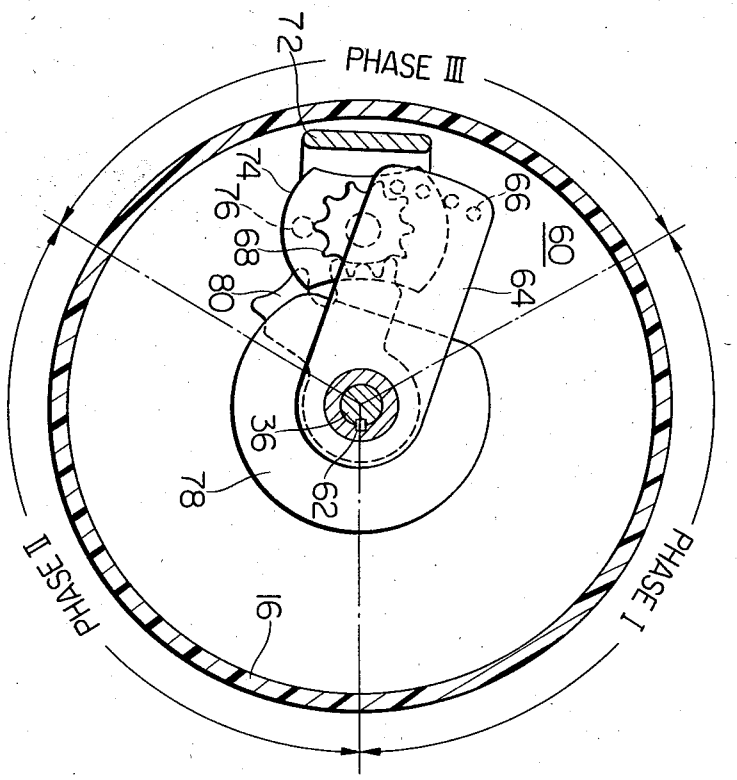
FIG. 4 is a sectional view taken along the line IV—IV of FIG. 3.
Figure 5:
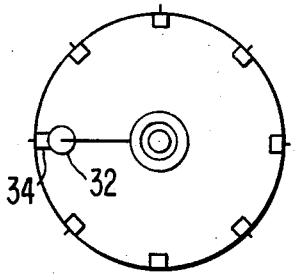
FIG. 5. PRIOR ART
FIGS. 5 through 8 are schematic cross-sectional views respectively taken along lines V—V, VI—VI, VII—VII and VIII—VIII of FIG. 1.
Figure 6:
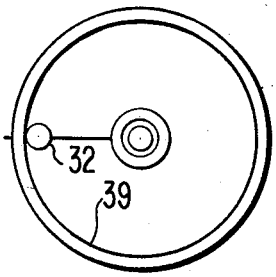
FIG. 6. PRIOR ART
Figure 7:
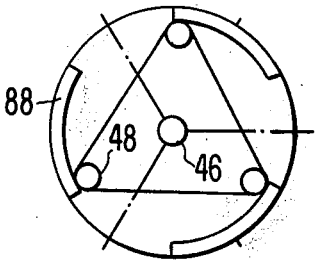
FIG. 7. PRIOR ART
Figure 8:
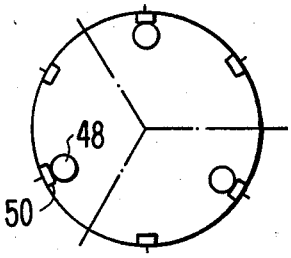
FIG. 8. PRIOR ART
Figure 9:
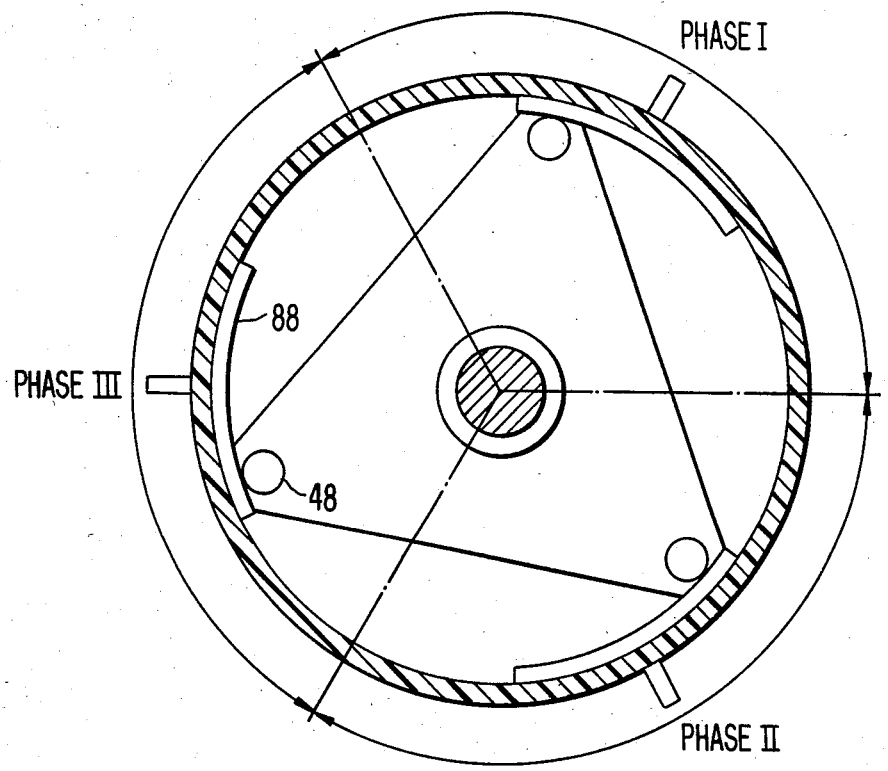
FIGS. 9 and 10 are schematic cross-sectional views respectively taken along lines IX—IX and X—X in FIG. 3.
Figure 10:
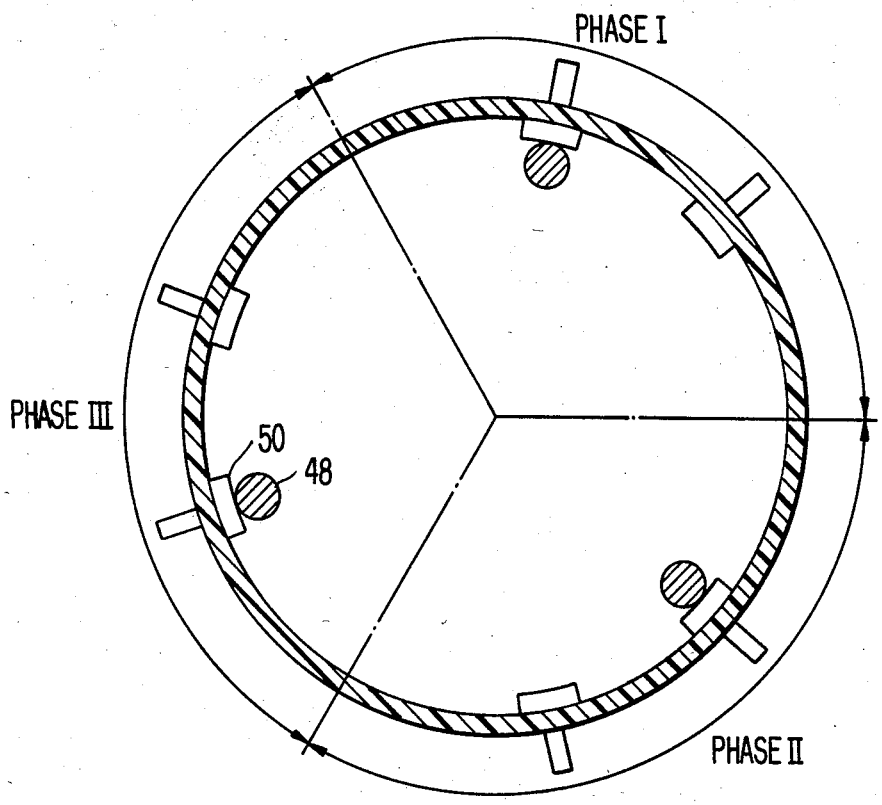

FIGS. 3 is a sectional view of one embodiment of a tap-changer according to the present invention, and FIGS. 4, 9 and 10 are respective sectional views taken along the lines IV—IV, IX—IX and X—X of FIG. 3. As the selector switch of this embodiment is identical to that of the conventional tap-changer shown in FIG. 1, it has been deleted from FIG. 3. Components shown in FIGS. 3 and 4 with the same reference numerals as those used in FIG. 1 are of the same construction as those shown in FIGS. 1 and 2, and their description is omitted.

In FIGS. 3 and 4, it is seen that the lower end of the input shaft 36 is connected to an intermittent drive mechanism 60, such as the one disclosed in British patent application Ser. No. 8,219,878 filed on July 9, 1982 and assigned to the same assignee as the present application. The input shaft 36 has securely mounted thereon by means of a key 62 a drive lever 64 having drive pins 66 at its outer end. The pins 66 engage a sprocket wheel 68 rotatably supported by a bearing 70 which is mounted on a support arm 72 rigidly extending from the partition wall 18. The sprocket wheel 68 has integrally mounted thereon a Geneva wheel 74 which has at its lower surface a drive pin 76. The drive lever 64 has integrally formed therewith a Geneva lock 78. The Geneva wheel 74 engages a Geneva follower wheel 80 at its drive pin 76. The follower wheel 80 is rigidly secured to the upper end of the output shaft 46 by a pin 82.

Referring also to FIGS. 9 and 10, it is also seen that the lower end of the output shaft 46 is rigidly connected by a pin 84 to an electrically insulating contact holder 86 which extends in the radial direction and rigidly carries a movable contact 48 at each end. The inner peripheral surface of the housing wall of the second insulating housing 16 has mounted thereon the fixed contacts 50 and current collecting contacts 88 of the change-over switch 90. Although not illustrated in FIG. 3, a similar contact assembly including an insulating holder and movable contacts as well as fixed contacts are also provided for the other two phases.

As seen from FIGS. 4, 9 and 10, according to the present invention, the second housing 16 may be considered to be equally segmented into three phase regions in which the fixed contacts 50 and 88 of each phase are positioned. These fixed contacts 50 and 88 are divided into three groups according to the phase to which they belong and the contact groups are separated in the circumferential direction on the cylindrical housing 16. Also according to the present invention, the intermittent drive mechanism 60 is arranged to be at an electrical potential equal to that of those contacts 32 and 34 of the selector switch 24 of the phase group which is closest to the intermittent drive mechanism 60, and the portion of the intermittent drive mechanism 60 that is closest to the contacts 50 of the change-over switch 90 (hereinafter referred to as "the closest portion") is positioned within the phase region corresponding with the phase group of the selector switch 24 nearest to the intermittent drive mechanism. Thus, in the case of the illustrated embodiment, the closest portion is located within the region for phase III. In the illustrated embodiment, the closest portion of the intermittent drive mechanism 60 is the lower end of the support arm 72 which is separated by a distance X from the current collecting contacts 88 of the change-over switch 90.

Since the on-load tap changer of the present invention is constructed as described above, as shown in FIG. 3, the distance X between the closest portion of the intermittent drive unit 60 and the collector contact 88 of the change-over switch 90 is substantially smaller than the distance Y on the other side of the intermittent drive mechanism 60 where there is no support arm 72, sprocket wheel 66, Geneva drive wheel 74, or the like. Therefore, when the electrical potential of the partition wall 18 and the intermittent drive unit 60 is set at the potential of the collector contact of the third phase (Phase III) of the selector switch 24 shown in FIG. 1, the voltages across the distances X and Y are as explained below.

If the sprocket wheel 66 and the Geneva wheel 74 were disposed within one of the phases other than the above Phase III, one half of the voltage across the transformer winding would appear across the gap distance X, and therefore a greater insulating distance able to withstand the above voltage would be required. However, in the present invention, since the sprocket wheel 68 and the Geneva wheel 74 are disposed within Phase III in which the voltages of the above-mentioned components are given, an entire voltage between the tap windings, which is significantly smaller than the one half of the voltage between the transformer winding turns, is applied across the above gap distance X, and within the other two phases, about one half of the above voltage between the transformer winding turns is applied across the gap distance Y which is longer than the above gap distance X, providing significant advantages in the design of the insulation.

Therefore, as is taught by the present invention, when the arrangement is made such that the phases of the change-over switch are separated in the circumferential direction and the electrical potential of a partition plate within the insulating housing and the electrical potential of an intermittent drive unit of the change-over switch are equal to the electrical potential of the collector contact of the lowermost phase of the selector switch and a portion of the intermittent drive unit that projects most toward the selector switch is disposed within the phase of the change-over switch which corresponds to the lowermost phase of the selector switch, the axial length of the change-over switch and of the tap changer as a whole can be reduced.

According to the on-load tap changer of the present invention, as described above, not only is the potential distribution suitable to the insulating distance permitted, allowing a reasonable insulating design, but also the axial lengths of the change-over switch as well as the entire on-load tap changer can be shortened, contributing to a compact design of a transformer resulting in a significant cost reduction.

What is claimed is:

1. A selector switch type on-load tap changer having a central axis, comprising:

an axially extending rotary selector switch operable as a diverter, including a plurality of selector contacts which are divided according to phases into selector groups which are arranged in the axial direction of the tap changer;

a rotary change-over switch axially spaced from said selector switch, including a plurality of fixed change-over contacts which are divided into change-over groups corresponding to respective ones of said phases, which are arranged about said axis in corresponding angular segments about said axis in the circumferential direction of the tap changer; and means, including an intermittent drive mechanism disposed along said axis so as to be closer to one of said selector groups than to any of the others of said selector groups and so as to have the same electrical potential as one of the selector contacts of said one of said selector groups, for intermittently trasmitting the rotary motion of said change-over switch to said selector switch, said intermittent drive mechanism having a shape which is asymmetrical with respective to said axis so as to have a closest portion that is located closer to the one of said change-over groups corresponding to the same phase as the phase to which said one of said selector groups corresponds, than to the others of said change-over groups, and that is located in the angular segment corresponding to said one of said change-over groups.

2. An on-load tap changer as claimed in claim 1, wherein said intermittent drive mechanism comprises a drive lever integrally formed with an input shaft coupled to said selector switch for rotation therewith, a sprocket wheel and a drive wheel of a Geneva gear driven by a driving pin of said drive lever, a Geneva follower for intermittently driving an output shaft of said change-over switch by said drive wheel, and a Geneva lock for locking said drive wheel at a predetermined position.

3. An on-load tap changer as claimed in claim 1, wherein said change-over switch includes movable contacts mounted on a contact holder which is integrally formed with said output shaft of said change-over switch, said movable contacts being movable in the circumferential direction of said tap changer about said axis, and said change-over contacts including stationary contacts and collector contacts mounted on the inner peripheral wall of said insulating housing, said movable contacts separably corresponding to said stationary contacts while being always in electrical engagement with said collector contacts.

4. An axially extending selector switch type on-load tap changer for changing the taps to a multiphase power source, having a central axis, said tap changer comprising:

an insulative housing;

a selector switch operable as a diverter, enclosed in said housing and having a plurality of fixed selector contacts arranged in groups according to phases in the axial direction of the tap changer, including a lowermost group of selector contacts, including a collector contact, at one axial end of said plurality of fixed selector contacts;

a change-over switch enclosed in said housing axially spaced below said selector switch, having a plurality of fixed change-over contacts arranged according to said phases in change-over groups in corresponding angular segments about said axis;

a partition plate within said housing separating said selector switch from said change-over switch; and means, including an intermittent drive mechanism, for intermittently transmitting motion of said change-over switch to said selector switch, said intermittent drive mechanism and said partition plate being arranged so as to be at a same electrical potential as said collector contact of said lowermost group, said intermittent drive mechanism having a portion disposed in the angular segment corresponding to the phase of said lowermost group of selector contacts and projecting toward said lowermost group, said portion being the part of said intermittent drive mechanism closest to said selector switch.

* * * * *